United States Patent [19]

Dinos

[11] Patent Number: 4,983,410

[45] Date of Patent: Jan. 8, 1991

[54] DISPOSABLE EXPANDABLE TEA CARTRIDGE

[75] Inventor: Jack A. Dinos, Atlanta, Ga.

[73] Assignee: Southern Tea Company, Marietta, Ga.

[21] Appl. No.: 232,947

[22] Filed: Aug. 17, 1988

Related U.S. Application Data

[63] Continuation-in-part of Ser. No. 111,719, Oct. 23, 1987.

[51] Int. Cl.[5] ..... A47G 19/16; A47J 31/00; B65D 85/00

[52] U.S. Cl. ..... 426/77; 426/110; 426/111; 426/112; 426/435; 99/295; 99/306

[58] Field of Search ..... 426/77-84, 426/112, 110, 111, 433, 435; 99/295, 306

[56] References Cited

U.S. PATENT DOCUMENTS

| | | | |
|---|---|---|---|
| 1,894,345 | 1/1933 | Cooper . | |
| 1,912,963 | 6/1933 | Blum | 426/77 |
| 2,186,087 | 1/1940 | Yates | 426/77 |
| 2,292,101 | 8/1942 | Brown . | |
| 2,377,118 | 5/1945 | Weisman | 426/77 |
| 2,447,754 | 8/1948 | Hirschhorn . | |
| 2,673,805 | 3/1954 | Colman | 426/111 |
| 2,715,868 | 8/1955 | Brown . | |
| 2,716,607 | 8/1955 | Waline . | |
| 2,824,002 | 2/1958 | Hiscock | 426/77 |
| 3,083,100 | 3/1963 | Baran . | |
| 3,083,101 | 3/1963 | Noury . | |
| 3,119,694 | 1/1964 | Gauld . | |
| 3,345,935 | 10/1967 | Waline . | |
| 3,357,340 | 12/1967 | Berns et al. | 99/295 |
| 3,373,677 | 3/1968 | Petrozzo . | |
| 3,384,004 | 5/1968 | Perlman . | |
| 3,385,201 | 5/1968 | Martin . | |
| 3,387,553 | 6/1968 | Tavera . | |
| 3,389,650 | 6/1968 | Michielsen . | |
| 3,445,237 | 5/1969 | Gidge . | |
| 3,446,624 | 5/1969 | Luedtke . | |
| 3,511,666 | 5/1970 | Hudon et al. . | |
| 3,519,439 | 7/1970 | Dunn | 426/111 |
| 3,566,772 | 3/1971 | Oliver et al. . | |
| 3,579,350 | 5/1971 | Rudd et al. . | |
| 3,651,349 | 3/1972 | Endo . | |
| 3,671,270 | 6/1972 | Jehn | 426/111 |
| 3,692,536 | 9/1972 | Fant | 426/79 |
| 3,823,656 | 7/1974 | Vander Veken . | |
| 3,888,999 | 6/1975 | Jones et al. . | |
| 3,889,000 | 6/1975 | Cante et al. . | |

(List continued on next page.)

FOREIGN PATENT DOCUMENTS

| | | | |
|---|---|---|---|
| 900870 | 5/1972 | Canada . | |
| 3612227A | 11/1988 | Fed. Rep. of Germany | 426/77 |
| 587629 | 1/1959 | Italy | 99/306 |
| 816805 | 7/1959 | United Kingdom | 426/83 |
| 914678 | 1/1963 | United Kingdom | 426/77 |
| 939934 | 10/1963 | United Kingdom | 426/77 |
| 1013665 | 12/1965 | United Kingdom | 426/113 |

*Primary Examiner*—Steven Weinstein

*Attorney, Agent, or Firm*—Foley & Lardner, Schwartz, Jeffery, Schwaab, Mack, Blumenthal & Evans

[57] ABSTRACT

A disposable cartridge and a method for brewing tea while high temperature liquid is passed through the tea includes a receptacle formed of liquid-permeable sheet material and defining a cavity for receiving tea. A quantity of tea is provided in a portion of the cavity. An inflatable cover, also formed of liquid-permeable sheet material, completely covers the portion of the cavity containing the tea. The cover is sealingly connected to the receptacle. The cartridge is placed within the brewing basket of a drip brewer and closely interfits with the interior thereof so as to substantially take up all the space in at least a lower portion of the basket. Hot liquid is supplied from the drip brewer to drip into the receptacle and, in response to the liquid permeating the cover and temporarily accumulating in the portion of the cavity containing the tea, the tea expands in the cavity and the tea brews therein. The cover inflates in an outward direction to accommodate expansion of the tea as it becomes saturated with the hot liquid to thereby enhance the brewing of the tea.

3 Claims, 5 Drawing Sheets

U.S. PATENT DOCUMENTS 3,971,305 7/1976 Daswick .
3,985,069 10/1976 Cavalluzzi .
4,069,751 1/1978 Gronwick et al. .
4,075,107 2/1978 Smith .
4,098,177 7/1978 Olney et al. .
4,099,453 7/1978 Kaplan .
4,112,831 9/1978 Scott .
4,167,899 9/1979 McCormick .
4,303,525 12/1981 Stover .
4,382,402 5/1983 Alvarez .
4,446,158 5/1984 English .
4,471,689 9/1984 Piana .
4,520,716 6/1985 Hayes ..... 99/295
4,550,024 10/1985 le Granse .
4,579,048 4/1986 Stover .
4,619,766 10/1986 Smiley et al. .
4,735,719 4/1988 Benedict .
4,771,680 9/1988 Snowball et al. ..... 99/295

DISPOSABLE EXPANDABLE TEA CARTRIDGE

CROSS REFERENCE TO RELATED APPLICATION

This is a continuation-in-part of co-pending U.S. patent application Ser. No. 111,719, filed Oct. 23, 1987, the disclosure of which is hereby incorporated herein by reference.

BACKGROUND OF THE INVENTION

This invention relates generally to brewing tea and more specifically to a disposable cartridge containing tea for use with a drip brewer wherein a high temperature liquid is passed through the cartridge thus brewing the tea.

The brewing of tea is generally achieved by passing a high temperature liquid, i.e., water (approximately at the boiling point) over dried tea leaves which, when wetted, expand approximately four times in volume in the wetted state as compared to the dried state. Tea leaves require sufficient contact time with the high temperature liquid, to permit proper infusion of the liquid into the tea leaves, not merely passing of the liquid over the leaves. The tea leaves also need room to expand for proper brewing while in contact with the high temperature liquid to permit the tea leaves to steep in the liquid.

In preparing brewed beverages, automatic drip brewers have become widely accepted for their convenience, ease of use, quality of brew produced and speediness in operation. Automatic drip coffee makers are very common and prevalent in homes, restaurants and institutions. At times, such automatic drip-coffee making machines have been used in brewing tea due to the ready availability, convenience, ease of use, etc., of such machines. Yet, tea requires slower brewing than does coffee, and automatic drip coffee makers tend to pass the hot water through the brew basket too quickly for effective tea brewing unless they have a restricted orifice in the brew basket. Even then, there is the problem of tea leaves and hot liquid overflowing the top of the filter. If tea bags are used in the brew baskets of automatic drip coffee makers, hot brewing liquid will tend to bypass the tea bags and provide a dilute and inadequately brewed beverage.

It is known to provide automatic drip brewing machines specifically designed for brewing tea, which machines are intended for commercial and institutional use in brewing large quantities of iced tea. Such automatic drip tea brewing machines, while more suitable for brewing tea than machines designed for brewing coffee, still fail to provide the potential advantages as suggested herein. Thus, even in the context of the automatic drip brewing machines designed for tea, the need exists for an improved brewing process and improved tea packaging. It is an object of the present invention to fulfill these needs in the contexts of all types of automatic drip brewing machines.

An important advantage could be obtained by combining with the advantages of automatic drip brewers the additional advantages of the tea bags. Tea bags provide the user with pre-measured amounts of tea leaves enclosed in discrete, convenient-to-use parcels which also provide the filter medium for effecting brewing. As already discussed, however, ordinary tea bags are not suitable for use in automatic drip coffee makers.

In the brewing of coffee, pre-packaging of ground coffee in the filter medium has met with only limited success. There is a problem of oils from the ground coffee seeping into and saturating the filter paper or other filter medium prior to use. Also, approximately triple the amount of ground coffee, by weight, is required to produce a given volume of brewed coffee, as compared with the amount of tea leaves required to produce the same volume of brewed tea. Thus, because coffee is relatively voluminous, ground coffee prepackaged in a filter medium has entailed compression of the ground coffee into a solid mass to minimize its bulk. In such arrangements utilizing compressed ground coffee, the filter medium is tightly bound around the compressed ground coffee. Such packaging would not be suitable for tea, because tea needs to expand considerably during brewing, as already described.

The potential for convenient and consistent brewing of tea utilizing an automatic drip process has heretofore remained unrealized. In particular, the special suitability of tea for pre-packaging in a filter medium which takes the form of a cartridge for an automatic drip brewing machine has been overlooked in the art, as has the potential for creating a disposable tea cartridge which may accommodate the considerable expansion which tea leaves undergo when they steep in hot water during the brewing process.

What has also been overlooked in the art is the potential for providing prepackaged, non-tamperable cartridges for brewing tea in automatic drip brewing machines. In this regard, the brewing of tea creates a need for ensuring that a correct measure and blend of tea leaves is consistently being supplied, just as with tea bags, but in the context of brewing tea utilizing automatic drip brewing machines.

While high liquid temperature is necessary for the brewing process, it later becomes a problem where the brewed product is to be used for iced tea. The high temperature of the freshly brewed tea melts the ice too quickly. To avoid this, the tea may be allowed to cool. This requires a substantial amount of time so that the freshly brewed tea is not immediately available for use.

SUMMARY OF THE INVENTION

In the present invention, a tea brewing cartridge for an automatic drip brewing machine is provided in which a cup shaped filter receptacle similar to a standard coffee filter contains a quantity of tea leaves and includes a cover sealed around the upper edge of the filter receptacle. The cover is nested within the filter receptacle so as to assume a sunken, collapsed, concave condition with respect to the filter receptacle. When hot water saturates the cartridge and the tea leaves expand, the cover unfolds, moving from a concave upward condition to an expanded convex upward condition to accommodate expansion of the tea leaves.

More specifically, the present invention provides for an article and method for brewing tea utilizing a disposable cartridge for brewing tea in which high temperature liquid is passed through tea leaves. The cartridge comprises a receptacle formed from liquid-permeable sheet material and defines a cavity for receiving tea. A quantity of tea is provided in a portion of the cavity. An inflatable initially concave upward cover formed of liquid-permeable sheet material completely covers the portion of the cavity containing the tea. The cover is sealingly connected to the receptacle at the upper edges only of the receptacle.

The receptacle may be used with a drip brewer to brew the tea. The receptacle is placed within the brewing basket of the drip brewer and closely interfits with the interior thereof so as to substantially take up all the space in at least a lower portion of the basket. Hot liquid is supplied from the drip brewer to drip into the receptacle whereby, in response to the liquid permeating the cover and temporarily accumulating in the portion of the cavity containing the tea, the tea expands in the liquid in that portion of the cavity and the tea brews therein. The cover inflates in an outward direction with respect to the interior of the cavity, by swelling up from the concave condition to a convex condition for accommodating expansion of the tea as it becomes saturated with the hot liquid to thereby enhance brewing of the tea.

The foregoing and other aspects of the invention will become apparent from the following detailed description of the invention when considered in conjunction with the accompanying drawing.

DETAILED DESCRIPTION OF THE PREFERRED EMBODIMENTS

Figure 1:
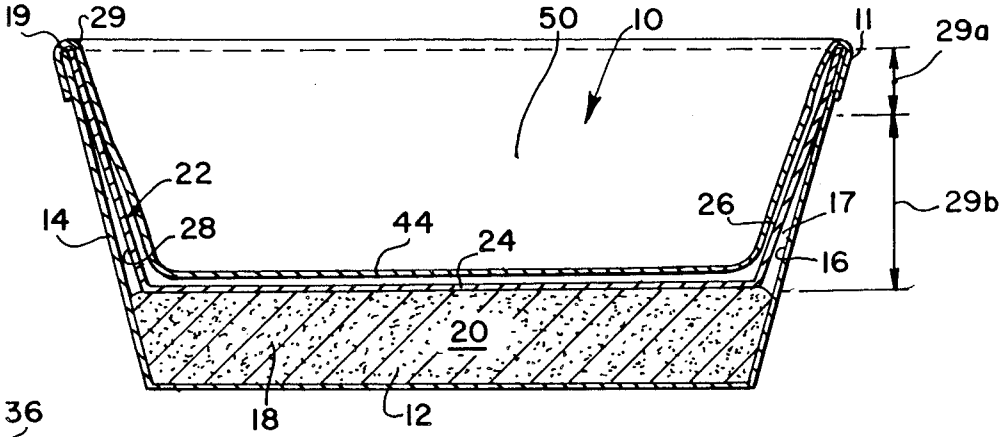
FIG. 1 is a cross-sectional side view illustrating an embodiment of the tea brewing cartridge of the present invention containing a portion of dried tea.
Figure 2:
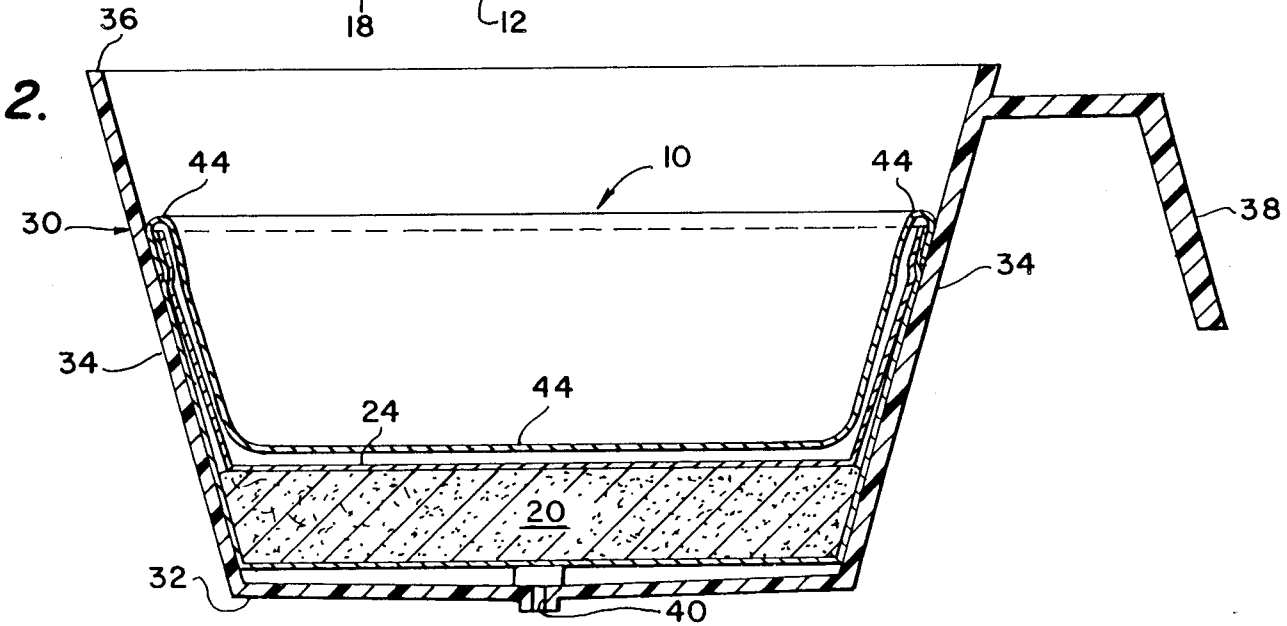
FIG. 2 is a cross-sectional side view illustrating an embodiment of the cartridge of FIG. 1 placed in a brewing basket of a drip brewer.
Figure 3:
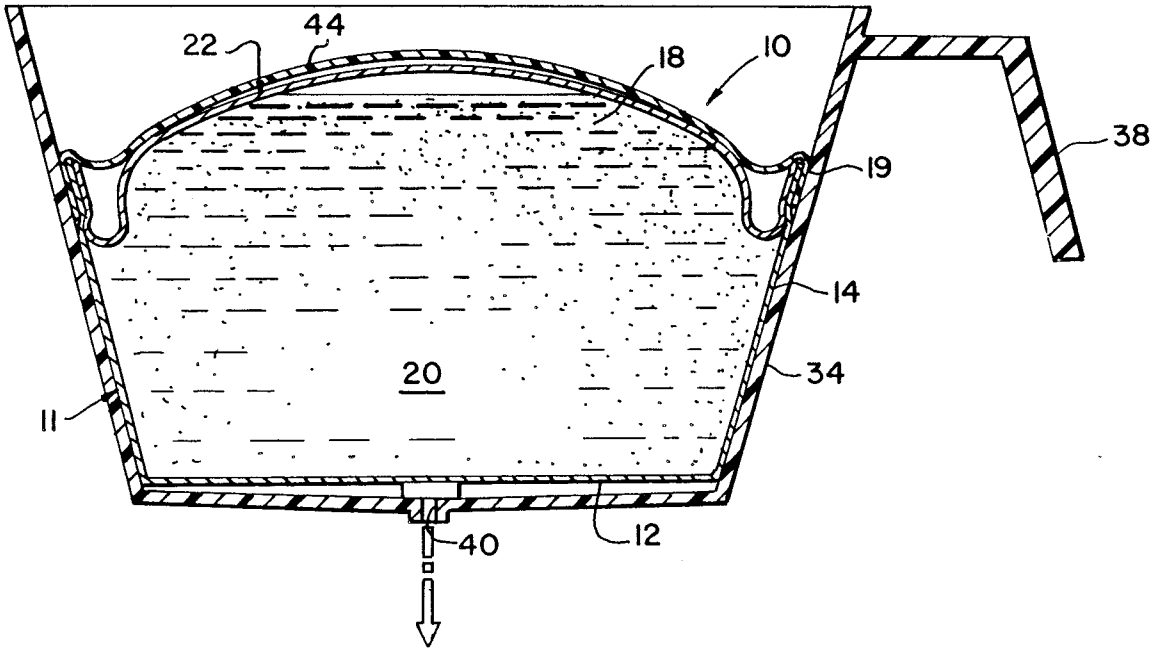
FIG. 3 is a cross-sectional side view illustrating an embodiment of the cartridge in the brewing basket wherein the tea has expanded in the hot liquid in a chamber of the cartridge during brewing.

A disposable cartridge for brewing tea while liquid is passed through the tea is generally designated by reference character 10 in FIGS. 1-3. Cartridge 10 is in the form of a receptacle 11 having a bottom portion 12 and a continuous annular pleated sidewall 14 to allow for expansion thereof and is composed of a relatively thin, liquid-permeable sheet material of the type formed of long-fiber paper. The paper has a known heat sealant material on one side 16 thereof. As such, the bottom portion 12 and the sidewall 14 define a cavity 17 which cavity 17 constitutes all of the space within the bounds of receptacle 11. Sidewall 14 defines a terminal annular rim 19.

A quantity of tea 20 is provided in a portion of cavity 17 adjacent bottom portion 12 which portion constitutes tea containing chamber 18. The tea 20 comprises numerous pieces of dried tea leaves which, when wetted, expand substantially and, when wetted with a high temperature liquid such as hot water, are subjected to infusion of the water thus extracting tea essence from the leaves for the forming of a flavorful drink.

An inflatable liner or cover 22 is formed of the same liquid-permeable sheet material as described above for receptacle 11. Cover 22 comprises a bottom portion 24 and a continuous annular pleated sidewall 26 to allow for expansion thereof. Cover 22 divides cavity 17 into tea containing chamber 18 and an open reservoir 50.

Cover 22 also has the above-mentioned sealant material on one side 28 thereof. Side 28 of cover 22 is adjacent side 16 of receptacle 11. Sidewall 26 defines a terminal annular rim 29 in sealed abutment with rim 19 of sidewall 14 along an annular heat sealed area **29*a*. Tea 20 is thus sealed between spaced-apart bottom portions 12, 24 of the receptacle 11 and the cover 22**, respectively.

Since sealing is effected only adjacent the rim in heat sealed area **29*a*, non-sealed portions of adjacent sidewalls 14, 26 are located in a non-sealed area 29*b* extending between bottom portion 24 of cover 22 and sealed area 29*a*. As such, cover 22 is inflatable relative to receptacle 11 by virtue of the movement of bottom portion 24 of cover 22 and the non-sealed portion of sidewall 26 of cover 22 relative to the corresponding bottom portion 12 and relative to the portion of sidewall 14 in non-sealed area 29*b* while chamber 18 expands. See FIG. 3. That is, during expansion of chamber 18, cover 22** moves from the concave upward configuration of FIGS. 1 and 2 to the convex upward configuration of FIG. 3.

Cartridge 10 may be used in connection with a conventional drip brewer of the type generally used for brewing coffee and including a well-known basket 30 (FIG. 2) having a bottom portion 32, a continuous sidewall 34 terminating at an annular rim 36 and a handle 38 connected to sidewall 34 adjacent rim 36. Liquid admitted into basket 30 passes into open reservoir 50 of cartridge 10, permeates cover 22, is absorbed into and bathes tea 20, passes through the receptacle, and passes to a receiver such as a pot, via a restricted orifice 40.

The liquid which permeates cartridge 10 wets the sidewall 14 causing sidewall 14 to adhere to sidewall 34 of basket 30 so that the liquid remains in chamber 18 formed between receptacle 11 and cover 22. Due to the high temperature of the liquid, the tea 20, the water, and some steam fill and expand the chamber 18 to about four times the dry tea volume to infuse the tea 20 and cause a steeping and expansion thereof during the brewing process. The inflating cover 22 traps much of the heat of the hot brewing liquid in infusing chamber 18 for enhanced brewing. Due to the substantial sealing contact between sidewalls 14 and 34, and due to the retention of tea 20 in the expansion chamber 18 by the inflating cover 22, the liquid is limited from overrunning rim 19 of sidewall 14 of cartridge 10, and instead, the liquid is retained in chamber 18 for an extended contact time with the tea 20. The brewed tea exits chamber 18 via bottom portion 12 of cartridge 10 and restricted orifice 40.

If desired, a flexible handle 44 formed of a Mylar strip may be attached to receptacle 10 by heat sealing. Flexible handle 44 extends entirely across the top of cartridge 10 in overlying relationship with cover 22. The strip which forms handle 44 extends around rim 29 to the outside of cartridge 10 and is heat sealed to cartridge 10 at heat seal area **29*a*. With handle 44, the receptacle 10 may be easily placed into basket 30, and more importantly, the used cartridge 10 may be easily removed from basket 30. The handle 44 is particularly useful when the used cartridge 10 is wet and in cases where removal takes place immediately after brewing, when the cartridge 10** is still hot.

Figure 4:
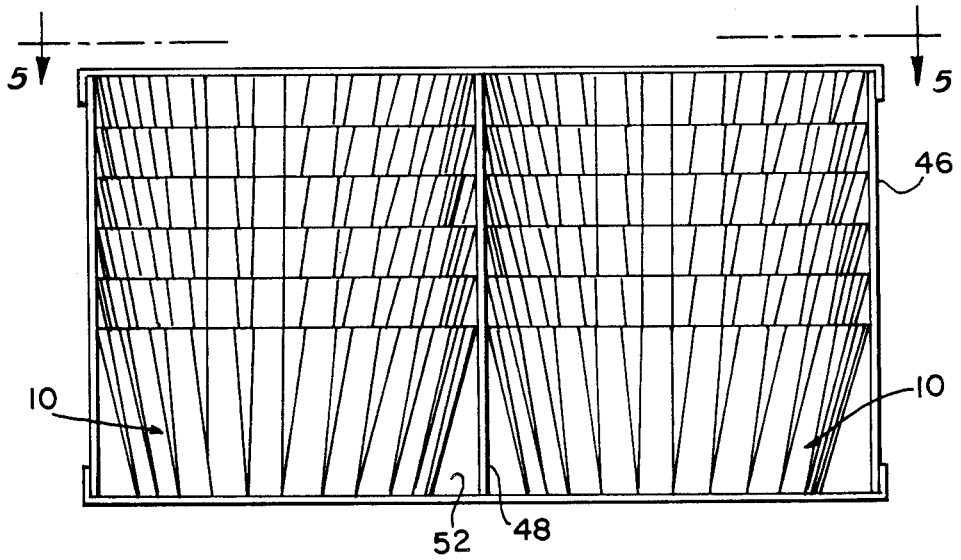
FIG. 4 is a cross-sectional side view illustrating stacks of nested cartridges packed for shipment.
Figure 5:
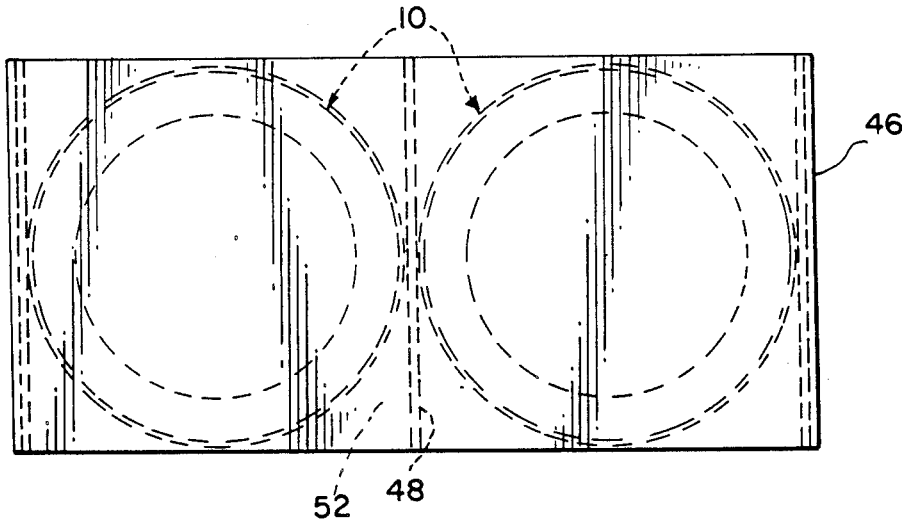
FIG. 5 is a plan view taken along the line 5—5 of FIG. 4.

As illustrated in FIGS. 4 and 5, a plurality of cartridges 10 are readily stackable in nested fashion for packing, shipping and storage. A carton 46 may include dividers 48 defining compartments 50 where nested stacks of receptacles 10 may be retained and made available for use. The particular construction of cartridge 10, by which each includes a deep, open reservoir or recess 50 in the dry condition (FIG. 1) presents an arrangement which is ideal for nested stacking. It will be seen that each succeeding cartridge in each stack will be nested within recess 50 of the preceding cartridge.

A limitation in using freshly brewed tea for making iced tea is that the high temperature of the freshly brewed tea, being at about the brewing temperature, melts the ice substantially and quickly when poured directly over the ice, thus diluting the tea and reducing the potential for the ice to continue to cool the tea. In order to reduce this tendency, the receptacle 10 of the present invention is used to brew a concentrated tea in the following manner. First, the receptacle 10 is placed in basket 30 of the above-mentioned conventional drip brewer, and the basket is positioned for brewing. The amount of liquid (preferably water) needed to brew normal strength tea is placed in the receiver of the drip brewer, i.e., the pot. Part of the water from the pot is then delivered to the inlet of the brewer to be conducted through the heating conduits and the basket of the brewer in the normal manner. The pot is then placed on a pad directly below the basket. The pot contains the other part of the water. This other part of the water is not passed through the brewer but remains in the pot and therefore is not heated. The heated part of the water brews tea concentrate in the cartridge 10 as described. The concentrate passes from cartridge 10 in basket 30 to the pot and is immediately cooled due to the relatively lower temperature of the other part of the water remaining in the pot. As a result, the concentrated brewed tea is immediately cooled and diluted when received in the pot. This cooled, brewed tea is ready for use as iced tea, and when poured over ice, does not quickly melt the ice as would be the case with a freshly brewed tea substantially at brewing temperature.

For small quantities of brewed tea, approximately 50% of the water for the ultimate brew is delivered to the inlet of the automatic drip brewing machine, the other 50% of the water being used to dilute the concentrate. For larger quantities of brewed tea, less than half the water for the ultimate brew is delivered to the inlet of the brewing machine to make the tea concentrate. The concentrate is then mixed with more than one half of the water needed for the ultimate brew, to provide a cooled brew at the proper strength for consumption.

The present invention is a substantial improvement in the brewing of tea due to the cartridge with the expandable chamber wherein the tea expands with the proper contact time in liquid suspension to move the cover of the cartridge from a concave to a convex condition. Tests have illustrated that the novel cartridge of this invention increases tea solids, in parts per million (ppm), in tea brewed in the expandable cavity receptacle versus tea brewed in a similar cartridge, but one which does not allow for expansion of chamber 18. In a particular test, wherein water hardness was carefully monitored, an increase of 27 ppm tea solids, i.e., 8.5% greater, was noted in tea brewed in accordance with the present invention, as compared to tea brewed in a similar cartridge in which chamber 18 was not permitted to expand.

Although the invention has been described with reference to preferred embodiments, it will be understood that modifications and changes can be made without departing from the scope and spirit of the invention.

What is claimed is:

1. A disposable cartridge for brewing tea by passing hot water therethrough, which cartridge is in a dry condition prior to brewing and which assumes a wetted condition when exposed to hot liquid during brewing, the cartridge being for placement in a brewing basket of a brewing machine, the brewing basket having a side wall extending generally upwardly from a bottom portion, the cartridge comprising:

(a) a cup shaped receptacle formed of liquid permeable sheet material, said receptacle defining a cavity, said receptacle having a bottom wall and a circumferentially continuous upstanding side wall, with said cartridge being dimensioned such that said receptacle side wall sealingly engages said side wall of the brewing basket in the wetted condition of the cartridge;

(b) a concave cup shaped cover formed of liquid permeable sheet material and having a bottom wall and a circumferentially continuous upstanding side wall, said cover and said receptacle side wall each defining a terminal annular rim, respectively, with said annular rim of said cover joined to said annular rim of said receptacle such that said cover is nested within said receptacle in the dry condition to assume a concave condition relative to said receptacle, said cover bottom wall and said receptacle bottom wall being spaced apart and defining an expandable tea containing chamber therebetween;

(c) a premeasured quantity of dry, infusible tea leaf in said team containing chamber;

(d) said cover side wall and said receptacle side wall being unsealed to each other except at said annular rims, with said cover side wall in the dry condition being in close overlying proximity with said receptacle side wall, said cover sidewall being unsealed to said receptacle side wall and configured such that said cover is inflatable relative to said receptacle by virtue of the movement of said cover bottom wall and unsealed cover side wall relative to said receptacle when said cartridge is wetted during infusion and said tea expands, so that said cover side wall in the wetted condition will be spaced away from said receptacle side wall in an unfolded relationship therewith, with said cover having an overall upwardly convex shape when the cartridge is in the wetted condition; said cover capable of expanding to accomodate at least substantially the full expansion of the wetted tea.

2. The cartridge of claim 1, wherein said receptacle side wall is pleated about its periphery.

3. The cartridge of claim 1, wherein said annular rims are joined together by heat seal.

* * * * *

UNITED STATES PATENT AND TRADEMARK OFFICE

CERTIFICATE OF CORRECTION

PATENT NO. : 4,983,410

DATED : January 8, 1991

INVENTOR(S) : Jack A. Dinos

It is certified that error appears in the above-identified patent and that said Letters Patent is hereby corrected as shown below:

Column 6, line 40, delete "team" and insert -- tea -- therefor.

Signed and Sealed this

Twenty-seventh Day of April, 1993

*Attest:*

MICHAEL K. KIRK

*Attesting Officer*

*Acting Commissioner of Patents and Trademarks*